US005858135A

United States Patent [19]

Niemczura et al.

[11] Patent Number: 5,858,135

[45] Date of Patent: Jan. 12, 1999

[54] METHOD FOR COLD ROLLING AND ANNEALING STRIP CAST STAINLESS STEEL STRIP

[75] Inventors: Zofia E. Niemczura, Valparaiso; Kenneth E. Blazek, Crown Point, both of Ind.

[73] Assignee: Inland Steel Company, Chicago, Ill.

[21] Appl. No.: 902,244

[22] Filed: Jul. 29, 1997

[51] Int. Cl.[6] ..... C22C 38/40; C21D 8/02

[52] U.S. Cl. ..... 148/610; 148/611; 148/327

[58] Field of Search ..... 148/610, 611, 148/327

[56] References Cited

U.S. PATENT DOCUMENTS

| | | | |
|---|---|---|---|
| 5,030,296 | 7/1991 | Ueda et al. | 148/2 |
| 5,188,681 | 2/1993 | Teraoka et al. | 148/641 |
| 5,492,575 | 2/1996 | Teraoka et al. | 148/542 |

FOREIGN PATENT DOCUMENTS

| | | | |
|---|---|---|---|
| 0 594 865 A1 | 5/1994 | European Pat. Off. | B22D 11/06 |
| 0 594 866 A1 | 5/1994 | European Pat. Off. | C22C 38/00 |
| 54-138811 | 10/1979 | Japan | 148/327 |

OTHER PUBLICATIONS

Zygo Corporation, Laurel Brook Rd., Middlefield, CT 06455, "New View 100 Operation Manual OMP–0348B," pp. 1–1 to 3–16 and Appendix A (Dec., 1993).

Zygo Corporation, Laurel Brook Rd., Middlefield, CT 06455, "MetroPro Surface Texture Parameters," pp. 1–9 (1996).

*Primary Examiner*—Deborah Yee

*Attorney, Agent, or Firm*—Marshall, O'Toole, Gerstein, Murray & Borun

[57] ABSTRACT

A method for producing strip cast, austenitic stainless steel strip comprises providing a strip cast strip having an initial microstructure including a detrimental amount of delta ferrite and a detrimental amount of dendritic structure is provided. The strip may have a composition comprising the following ingredients: 0.4 wt. % max. carbon, 5–38 wt. % nickel, and 15–28 wt. % chromium. The strip is subjected to a cold rolling step prior to any annealing step. Upon subsequent annealing, (a) the amount of delta ferrite in the strip is reduced to substantially below the detrimental amount of delta ferrite that was in the strip prior to cold rolling and (b) the amount of dendritic structure in the strip is reduced to below the detrimental amount of dendritic structure that was in the strip prior to cold rolling. By employing the method of the present invention, an austenitic stainless steel strip having a high quality surface is produced. After cold rolling and annealing, the microstructure of the strip may comprise austenitic and less than about 10% delta ferrite by volume.

42 Claims, No Drawings

METHOD FOR COLD ROLLING AND ANNEALING STRIP CAST STAINLESS STEEL STRIP

BACKGROUND OF THE INVENTION

The present invention is directed generally to stainless steel strip casting. More particularly, the present invention is directed to Cr—Ni austenitic stainless steel strip and methods for producing the same employing strip casting.

One conventional method for producing stainless steel strip employs ingot casting. In ingot casting, molten steel is brought to a pouring stand in a steel ladle that usually holds about 200 tons of liquid steel. A series of ingot molds are positioned next to the pouring stand on top of ingot cars. Each ingot mold sits on a mold base which prevents leakage of the molten metal from the bottom of the ingot molds. The ingot molds are hollow tubes, rectangular in cross-section, made of cast iron. The ingot mold cross-sections are usually about 2 feet by 3 feet (0.6 m by 0.9 m), and the heights of the ingot molds are about 8 feet (2.4 m). The total weight of the steel required to fill a mold is usually about 10 to 20 tons.

Because the cross-section of an ingot mold is very large and the mold is not cooled by any means other than convection from the exterior surface of the mold, the cooling rate for most of the metal in the ingot mold is very low. Therefore, very large, branched crystals, called dendrites, form upon solidification, and hence, a very large grain size exists in the as-cast microstructure. The formation of large dendrites as a result of the slow cooling rate results in large volumes of segregated liquid solidifying around the branches of the dendrites (dendritic segregation), making the casting susceptible to internal cracking and voids.

After solidification and substantial cooling, the ingot is separated from the ingot mold and placed into a heating zone called a soaking pit where the ingot is reheated to a temperature above 2000° F. (1093° C.) to prepare the ingot for hot rolling. During an initial hot rolling operation called blooming, the ingot is reduced in width from about 2 feet (0.6 m) to approximately 7 to 10 inches (18 cm to 25.4 cm). The resulting semi-finished product is called a slab. The microstructure of the slab is very similar to that of the ingot and includes, predominantly, large dendrites and other large grains from the as-cast microstructure. Some of the as-cast microstructure was eliminated by the blooming operation, but not a significant portion because the amount of reduction resulting from the blooming operation is only about 2:1.

The slabs are transported to a hot strip mill where each slab is reheated to above 2000° F. (1093° C.) before undergoing additional hot rolling into a strip. After reheating, the slabs are sent through a series of roughing stands and then through a series of finishing stands in the hot strip mill to produce a strip having a thickness of about 0.1 inches (0.25 cm) which is then coiled. The hot working which the strip undergoes in the roughing and finishing stands usually is sufficient to break up almost all of the as-cast microstructure because the amount of reduction is about 100:1. The resulting grain size in the strip is usually rather large and can be controlled to some extent by controlling the cooling rate the strip undergoes after hot working in the hot strip mill and prior to coiling.

To produce a final product, the hot rolled strip is subjected to processing steps that include a first anneal, a first cold rolling, a second anneal, a second cold rolling, and a third anneal. The anneals may all be performed at temperatures in the range 900°–1150° C., for example, and the cold rolling steps may each produce a reduction of 50–65%. After the third anneal, typically a skin pass is performed on the strip. The skin pass is a cold rolling operation that produces small amounts of reduction (e.g., 0.5–2%) in the strip. The surface quality of the resulting strip, in terms of surface defects, roughness, reflectability and other conventional surface parameters, is generally very good. Ingot casting, however, is a relatively inefficient and uneconomical method for producing stainless steel strip.

Another method for producing stainless steel strip employs strip casting. In strip casting, molten metal is cast directly into a strip that is about 1.5–6 mm thick. One type of strip casting is twin roll casting. Twin roll casting is typically performed on apparatus comprising a pair of horizontally spaced rolls mounted for rotation in opposite rotational senses about respective horizontal axes. The two rolls define a horizontally disposed, vertically extending gap therebetween for receiving molten metal. The gap defined by the rolls tapers arcuately in a downward direction. Molten metal in the gap forms a pool. The rolls are cooled and, in turn, cool the molten metal as the molten metal from the pool descends through the gap. A solidified metal strip emerges from the gap.

Procedures employing strip casting, in contrast to procedures employing ingot casting, do not employ hot rolling. Consequently, the resulting Cr—Ni austenitic stainless steel strip generally has a typical as-cast microstructure (i.e., a microstructure having detrimental amounts of dendrites and delta ferrite). The subsequent processing steps performed on the as-cast strip in conventional processes that employ strip casting are similar to those steps performed after the hot rolling step in processes that employ ingot casting. These steps include a first anneal followed by a first cold rolling, a second anneal followed by a second cold rolling, a third anneal and, typically, a skin pass.

Strip casting is more efficient and economical than ingot casting. However, the stainless steel final product of processes employing strip casting and conventional annealing and cold rolling practices, generally has a surface quality inferior to that of stainless steel strip produced by processes employing ingot casting and hot rolling followed by annealing and cold rolling. The inferior surface quality includes less reflectability, more roughness and less homogeneity. Microstructural factors contributing to the inferior surface quality include residual or inherited dendritic structure at the surface, chemical non-homogeneity at the surface, crystallographic non-homogeneity at the surface (i.e., bands with different crystal orientation or crystalline texture at the surface), and residual delta ferrite. Chemical and crystallographic non-homogeneity are caused, in part, by the dendritic segregation which occurred during strip casting.

The crystal structure of delta ferrite (body-centered cubic) is different than the crystal structure of austenitic (face-centered cubic), the difference contributing to the non-homogeneous surface appearance. The body-centered cubic delta ferrite has a different deformability than the austenitic, leaving a "streaked" surface appearance after cold rolling.

In procedures employing ingot casting, the subsequent hot rolling of the ingot cast steel breaks down the as-cast microstructure, causing dendritic homogenization and delta ferrite dissolution. Homogenization is mainly a diffusion-based process in which the dendrites, which are austenitic in the as-cast orientation, become austenitic that is no longer in the as-cast orientation. More particularly, during homogenization, the branches of the dendrites become smaller and more similar in chemical composition to the surrounding metal. Delta ferrite dissolution is the conversion of delta ferrite to austenite. Thus, very little or no dendritic structure and very little delta ferrite is present in the microstructure of stainless steel strip which has been ingot cast and then hot rolled. In contrast, in procedures employing strip casting, there is no hot rolling step, and the resulting as-cast strip generally has an as-cast microstructure including detrimental amounts of dendritic structure and delta ferrite.

Stainless steel strip made by processes employing strip casting followed by conventional annealing and cold rolling practices has relatively poor surface quality. The poor surface quality of such strip, compared to strip produced by processes employing ingot casting, has been attributed to the presence of detrimental amounts of dendritic structure and delta ferrite in the final product. In contrast, a desired, final product microstructure generally comprises a relatively low amount of delta ferrite and comprises essentially austenite, with very little or none of the austenite being dendritic. A desirable, final product microstructure has an amount of delta ferrite near the equilibrium amount which, in an austenitic stainless steel, is about 3–5% by volume.

To reduce the amount of delta ferrite in the strip cast product, attempts have been made to cool the strip quickly, immediately after casting, down to about 1100° C. Once the strip has cooled to about 1100° C., the cooling rate of the strip is drastically reduced to allow solid state diffusion to transform most of the remaining delta ferrite into austenite. Such fast cooling, however, risks crackling the surface of the strip if the cooling is not performed very carefully.

As described above, conventional cold rolling practice following the strip casting step typically includes three anneals, the first anneal being performed on the strip prior to any cold rolling step. Three anneals are necessary in the conventional methods in order to reduce, by dissolution and recrystallization, the amount of delta ferrite in the final product to a desired level and to reduce, by homogenization, the amount of dendritic structure. Employing three annealing steps, however, consumes a large amount of time and energy, resulting in a relatively inefficient overall process. Moreover, even after the third anneal, the final strip product often has poor surface quality. Thus, it is desirable to improve the surface quality of the final strip product and to reduce the number of processing steps in the strip casting of stainless steel strip.

SUMMARY OF THE INVENTION

The aforementioned disadvantages of the prior art are overcome by producing austenitic stainless steel strip in accordance with the methods of the present invention. More particularly, one such method includes the steps of: (1) providing a strip cast, austenitic stainless steel strip, the strip having a detrimental amount of delta ferrite and a detrimental amount of dendritic structure; (2) cold rolling the strip, prior to any annealing of the strip after casting, to mechanically fragment dendrites and delta ferrite and produce deformation-generated stored energy sufficient, upon subsequent annealing, (a) to reduce, by dissolution and recrystallization, the amount of delta ferrite in the strip to substantially less than the detrimental amount of delta ferrite and (b) to reduce by homogenization the amount of dendritic structure in the strip to substantially less than the detrimental amount of dendritic structure; and (3) annealing the cold rolled strip under time and temperature conditions which release the stored energy to reduce, by dissolution and recrystalization, the amount of delta ferrite in the strip to substantially less than the detrimental amount of delta ferrite and to reduce by homogenization the amount of dendritic structure in the strip to substantially less than the detrimental amount of dendritic structure.

The Cr—Ni austenitic stainless steel strip may comprise the following ingredients before cold rolling: 0.4 wt. % max. carbon, 5–38 wt. % nickel, and 15–28 wt. % chromium. The amount of delta ferrite in the strip prior to cold rolling can be greater than about 25% by volume, and the cold rolling and annealing steps may reduce, by dissolution and recrystallization, the amount of delta ferrite to below about 20% by volume. The cold rolling step may produce a deformation of at least about 40%, and the annealing step may be performed at a temperature of at least about 1100° C. for at least about 10 minutes. The strip may be in an as-cast condition at the commencement of the cold rolling step.

Another method for producing strip cast, austenitic stainless steel strip includes the three steps of the method described above and further includes the steps of: subjecting the strip to a second cold rolling step following the annealing step and subjecting the strip to a second annealing step following the second cold rolling step. The second cold rolling step and second annealing step further reduce the amount of the delta ferrite and essentially eliminate the dendritic structure from the strip. The method may also include the step of subjecting the strip, following the second annealing step, to a skin pass to improve the surface finish of the strip. The annealing steps may each be performed at temperatures in the range 900°–1300° C. The strip may be in an as-cast condition at the commencement of the first cold rolling step.

A further aspect of the invention is an austenitic stainless steel strip having the following properties: a composition comprising, as ingredients, 0.4 wt. % max. carbon, 5–38 wt. % nickel, and 15–28 wt. % chromium; and a microstructure comprising austenite and less than about 10% delta ferrite by volume. The microstructure has essentially no residual subsurface dendrites and the austenite has an average grain size of less than about 19 microns.

Other features and advantages are inherent in the methods and product claimed and disclosed or will become apparent to those skilled in the art from the following detailed description.

DETAILED DESCRIPTION

In accordance with the method of the present invention, a strip cast, Cr—Ni austenitic stainless steel strip is provided. The strip may be produced using a twin roll caster or other suitable strip casting apparatus. The composition of the steel may be that of any austenitic stainless steel including, for example, steels comprising the following ingredients: 0.4 wt. % max. carbon; 5–38 wt. % nickel; and 15–28 wt. % chromium. Particularly suitable steels are the 304 and 308 stainless steels and other steels with a ratio of wt. %Cr to wt. %Ni of from about 18/8 to about 20/9.

The strip, prior to cold rolling, has an amount of delta ferrite that is detrimental to the surface quality of the strip, and typically has greater than about 25% delta ferrite by volume. By comparison, the equilibrium amount of delta ferrite in austenitic stainless steel is about 3–5% by volume. The strip, prior to cold rolling, also has an amount of dendritic structure that is detrimental to the surface quality of the strip. The main detrimental aspects of the dendritic structure are the chemical segregation associated with the dendritic structure and the unique crystallographic orientation of the dendritic structure.

The strip is subjected to a cold rolling procedure. The strip may be in an as-cast condition at the commencement of the cold rolling procedure but, in any event, the strip is subjected to the cold rolling procedure prior to any annealing step. The strip may be subjected to a grinding and pickling step prior to cold rolling.

The cold rolling procedure mechanically fragments dendrites and delta ferrite and produces deformation-generated stored energy sufficient, upon subsequent annealing, (a) to reduce, by dissolution and recrystallization, the amount of delta ferrite in the strip to substantially less than the detrimental amount of delta ferrite and (b) to reduce by homogenization the amount of dendritic structure in the strip to substantially less than the detrimental amount of dendritic structure. In addition to providing deformation-generated energy for recrystallization and solid state diffusion, the cold rolling accelerates subsequent delta ferrite dissolution and dendritic homogenization by reducing dendrite sizes and dendrite branch or arm spacing. Also, the cold rolling mechanically breaks up some of the delta ferrite. The improvement of surface region homogeneity in particular, during subsequent annealing, is increased in efficiency by cold rolling the strip prior to first annealing the strip.

Cold rolling procedures which subject the strip to a reduction of at least 30%, preferably at least 40%, and more preferably at least 50%, produce sufficient deformation-generated stored energy to improve the microstructure of the strip after annealing, as described below. The as-cast strip is about 1.5–6 mm thick, typically 2.5–3.5 mm, and is cold rolled down to a thickness of about 0.75–4.2 mm, typically 1.2–1.7 mm, for example.

The cold-rolled strip is subjected to an annealing step under time and temperature conditions which release the stored energy from the cold rolling step to reduce, by dissolution and recrystallization, the amount of delta ferrite in the strip to substantially less than the detrimental amount of delta ferrite and to reduce by homogenization the amount of dendritic structure in the strip to substantially less than the detrimental amount of dendritic structure. Recrystallization of grains also occurs during annealing after cold rolling in the present invention.

Dissolution of delta ferrite is actually the conversion of delta ferrite into austenite, the austenite being desirable for a high quality surface on the final product. Homogenization is predominantly a diffusion-driven process in which the dendrites, which comprise austenite in an as-cast orientation, become crystals of austenite that lack the as-cast orientation and chemical segregation. Dendrite homogenization and delta ferrite dissolution are interrelated, the homogenization of the dendrites facilitating the dissolution of delta ferrite.

In conventional processes employing strip casting, the first anneal is performed on the strip prior to any cold rolling, and it is difficult to reduce the amount of delta ferrite after the first anneal. This difficulty has been attributed to the stabilization of the dendritic structure during that first anneal. Apparently, the stabilized dendritic structure makes removal of the delta ferrite by subsequent anneals particularly difficult.

In one embodiment of a method in accordance with the present invention, the first anneal is performed after cold rolling, and that anneal is conducted at a temperature of at least about 1100° C. for at least about 5 minutes and preferably for at least about 10 minutes; this is sufficient to reduce the amount of delta ferrite to substantially below the ascast amount of delta ferrite and to reduce the amount of dendritic structure to substantially below the as-cast amount of dendritic structure. After the anneal, the austenite grain size is about 15 microns.

The cold rolling and annealing steps described above preferably reduce the amount of delta ferrite from the as-cast amount (typically greater than 25% by volume) to below about 20% by volume. More preferably, the amount of delta ferrite is reduced to below about 15% by volume. The remainder of the microstructure is predominantly austenite.

Delta ferrite dissolves most rapidly during the first 10 minutes at 1100° C. and during the first 5 minutes at 1200° C. Longer annealing times and higher annealing temperatures may not be necessary to reduce the amount of delta ferrite to substantially below the detrimental amount. However, dendritic homogenization requires a longer time and a higher temperature than that needed for the dissolution of delta ferrite. A satisfactory homogenization takes place after about 20 minutes at about 1100° C. or after about 10–15 minutes at about 1200° C.

The crystallographic texture of the strip is affected by the processing steps. As-cast sheets have a sharp (100) texture, but cold rolling the strip prior to any annealing and then annealing the cold-rolled strip may promote randomization of the surface crystallographic texture in the strip.

Another embodiment of a method for producing strip cast, austenitic stainless steel strip in accordance with the present invention includes the following processing steps: providing a strip cast, austenitic stainless steel strip similar to the strip provided in the embodiment described above, and employing first cold rolling and annealing steps similar to the cold rolling and annealing steps employed in the embodiment described above. In addition, this embodiment further includes subjecting the strip to a second cold rolling step following the first annealing step, and then subjecting the strip to a second annealing step following the second cold rolling step. The strip may be subjected to a pickling step between the first annealing step and the second cold rolling step. The second cold rolling step and the second annealing step further reduce the amount of the delta ferrite and essentially eliminate the dendritic structure from the strip.

The first and second cold rolling steps may each produce a reduction of at least about 30%. For example, the first cold rolling step may produce a deformation of at least about 40% and the second cold rolling step may produce a deformation of about 30–40%.

The first annealing step may be performed at a temperature in the range 900°–1300° C., and preferably in the range 1100°–1200° C. The second annealing step may be performed at a temperature in the range 900°–1300° C. The time and temperature of the second annealing step required to achieve a microstructure without detrimental amounts of delta ferrite and dendritic structure are affected by the time and temperature of the first annealing step. This is so because the time and temperature of the second annealing step depend on the degree of homogenization completed during the first annealing step. Generally, the longer the time or higher the temperature of the first annealing step, the shorter the time and/or the lower the temperature required for the second annealing step. For example, when the first anneal is performed at 1200° C. for only about 3 minutes, a second anneal at 1100° C. for about 15 minutes or at 1200° C. for about 10 minutes should be performed on the strip. However, using more effective conditions for the first anneal (e.g., a longer time at 1200° C.) may reduce the second annealing time and temperature. For example, if the first annealing step is performed for at least about 10 minutes, then the second annealing step may be performed for at least about 3 minutes. Examples of suitable conditions for the first and second annealing steps are shown in Table 1.

TABLE 1

Example Annealing Cycles

| First Anneal | | Second Anneal | |
|---|---|---|---|
| Temp. (°C.) | Time (min.) | Temp. (°C.) | Time (min.) |
| 1100 | 10 | 1100 | 15 |
| 1100 | 15 | 1200 | 3 |
| 1200 | 3 | 1100 | 15 |
| 1200 | 10 | 1100 | 3 |
| 1200 | 5 | 1200 | 3 |

The following are further examples of suitable conditions for the first and second annealing steps. The first annealing step may be performed for at least about 3 minutes at a temperature in the range 900°–1300° C., and the second annealing step may be performed for at least about 3 minutes at a temperature in the range 900°–1300° C. The first annealing step may be performed at a temperature of at least about 1200° C. for at least about 3 minutes, and the second annealing step may be performed at a temperature of at least about 1200° C. for at least about 3 minutes. The first annealing step may be performed at a temperature in the range of 1050°–1200° C. for at least about 5 minutes, and the second annealing step may be performed at a temperature in the range of 1050°–1200° C. for at least about 5 minutes. The first annealing step may be performed at a temperature in the range of 1050°–1150° C. for at least about 10 minutes, and the second annealing step may be performed at a temperature of at least about 1150° C. for at least about 5 minutes. The first annealing step may be performed at a temperature of at least about 1200° C., preferably for about 3–5 minutes, and the second annealing step may be performed at a temperature in the range of 1050°–1150° C., preferably for at least about 3 minutes.

Cold rolling performed before the first annealing step increases the efficiency of surface region homogenization during subsequent annealing. The first annealing time and temperature appear to be more significant than the subsequent annealing time and temperature. Thus, a higher annealing time and a higher annealing temperature may be more effective at reducing dendritic structure and delta ferrite when used for the first anneal rather than for the second anneal.

In some embodiments of the method, the strip, after the first cold rolling and annealing steps and prior to the second cold rolling step, has at least about 15% delta ferrite by volume, and the second cold rolling step and second annealing step reduce, by dissolution and recrystallization, the amount of delta ferrite to below about 10% by volume. Preferably, the second cold rolling step and second annealing step reduce, by dissolution and recrystallization, the amount of delta ferrite to below about 5% by volume.

In other embodiments of the method, the as-cast strip has at least about 30% delta ferrite by volume, and the strip, after the first cold rolling and annealing steps and prior to the second cold rolling step, has about 11–20% delta ferrite by volume. In these embodiments, after the second annealing step, the strip has less than about 10% delta ferrite by volume. The average size of austenite grains in the strip, after the second annealing step, is preferably about 15–19 microns.

Particular combinations of first cold rolling reduction, first annealing time and temperature, second cold rolling reduction, and second annealing time and temperature may be used to produce a desired microstructure for the final product (i.e., a microstructure without detrimental amounts of delta ferrite and dendritic structure). For example, the first cold rolling step may produce a deformation of at least about 40%, the first annealing step may be performed at a temperature in the range of 1100°–1200° C. for at least about 5 minutes (preferably at least about 10 minutes), the second cold rolling step may produce a deformation of about 30–40%, and the second annealing step may be performed at a temperature in the range of 1100°–1200° C. for at least about 3 minutes. If the microstructure is not satisfactory, an increase in the first cold rolling reduction or an increase in the first annealing time or temperature may improve the microstructure.

Because the conventional process employing strip casting produces strip having surface quality problems even after three anneals, the placement of the present invention's first anneal (i.e., after a cold roll) appears to be significant. The first anneal in the conventional process employing strip casting occurs before the first cold rolling step and appears to stabilize the as-cast structure, causing residual surface problems to persist even after two subsequent anneals. In fact, some surface quality problems persist even in those conventionally processed strips in which the amount of delta ferrite has been reduced to a level similar to the level of delta ferrite in strips processed in accordance with the present invention.

The present method may also include the step of subjecting the strip, following the second annealing step, to a skin pass to improve the surface finish of the strip by flattening the surface and by compressing the surface to prevent cracks. The skin pass may produce a deformation of about 0.5–2%, and preferably produces a deformation of about 1.5%. A pickling step may be performed on the strip between the second annealing step and the skin pass.

Surface quality measurements such as the gloss index, the roughness average ($R_a$) and the waviness average ($W_a$) are typically taken after the strip has been subjected to a skin pass. The gloss index of the strip of the present invention is preferably at least 120. The gloss index is determined by following the ASTM Standard Test Method for Specular Gloss, D 523-89, listed in the ASTM Standard Book, Volume 06.01.

The topography of a surface includes roughness, which represents relatively fine deviations in the surface relative to a plane fit to the surface, and waviness, which is the component of surface topography upon which roughness is superimposed. The plane fit to the surface is essentially a plane, defined by the surface, from which deviations from the surface are measured. Roughness average ($R_a$) represents the average deviation of all points from the plane fit to the surface being tested. Waviness average ($W_a$) represents the average surface height, or average deviation, of all points from a plane fit to the waviness data. The plane fit to the waviness data is essentially a plane, defined by the waviness data, from which deviations are measured to determine waviness ($W_a$).

Both the roughness average and the waviness average are determined by utilizing a microscope having optical microscopy capability and interferometry capability to provide the raw data needed for imaging and for surface analysis. Surfaces are imaged and analyzed using scanning white light interferometry. Light from the microscope divides; one portion of the light reflects from the test surface and another portion of the light reflects from an internal, high quality reference surface. Both portions of light are then directed into a solid-state camera. Interference between the two light wavefronts results in an image of light and dark bands, called fringes, that indicate the surface structure of the sample being tested. A computer may be used to produce an image of the surface for display on a monitor and to analyze the surface topography of the sample being tested.

A cutoff filter attached to the microscope is used to determine the wavelength at which the surface structure is differentiated between roughness and waviness data. For the measurements made on austenitic stainless steel samples produced in accordance with the present invention, the cutoff filter was set at 0.03 inches (0.076 cm), which is the industry standard for determining roughness and waviness averages for steels similar, in a general sense, to those produced by the present invention. The roughness average ($R_a$) of strip produced in accordance with the present invention is preferably less than about 20 $\mu$inches (0.51 microns). The waviness average ($W_a$) is preferably less than about 12 $\mu$inches (0.30 microns).

A system suitable for determining roughness average ($R_a$) and waviness average ($W_a$) is sold by Zygo Corporation, Laurel Brook Rd., Middlefield, Conn. 06455, under the tradename NewView Zygo System with MetroPro software. Additional information regarding roughness average ($R_a$) and waviness average ($W_a$) can be found in the operation manual for the NewView Zygo System with MetroPro software.

The resulting steel, in addition to having an improved surface, is more homogeneous, both chemically and microstructurally, than conventionally processed, strip cast austenitic stainless steel. The homogeneity is attributable to the first cold rolling step, which is performed prior to any annealing of the strip.

In summary, a product produced in accordance with the present invention is an austenitic, stainless steel strip having a composition comprising, as ingredients, 0.4 wt. % max. carbon, 5–38 wt. % nickel, and 15–28 wt. % chromium. The microstructure of the strip comprises less than about 10% delta ferrite by volume, essentially no residual subsurface dendrites, and austenite having an average grain size of less than about 19 microns. Preferably, the microstructure has only about 3–5% delta ferrite by volume and an average grain size of less than about 16 microns. The strip may have a thickness in the broad range of 1.5–6 mm or in the narrower range of 2.5–3.5 mm. The strip may have one or more of any of the following surface qualities: a gloss index of at least 120, a roughness average of less than about 20 $\mu$inches (0.51 microns), and a waviness average of less than about 12 $\mu$inches (0.30 microns).

The foregoing detailed description has been given for clearness of understanding only, and no unnecessary limitations should be understood therefrom, as modifications will be obvious to those skilled in the art.

What is claimed is:

1. In a method for producing strip cast, austenitic stainless steel strip, the steps of:

providing a strip cast, austenitic stainless steel strip;

cold rolling said strip;

said strip having a detrimental amount of delta ferrite and a detrimental amount of dendritic structure at the time said cold rolling step is initiated;

said cold rolling step being performed prior to any annealing of said strip, to mechanically fragment dendrites and delta ferrite and produce deformation-generated stored energy sufficient, upon subsequent annealing, (a) to reduce, by dissolution and recrystallization, the amount of delta ferrite in said strip to substantially less than said detrimental amount of delta ferrite and (b) to reduce by homogenization the amount of dendritic structure in said strip to substantially less than said detrimental amount of dendritic structure;

and annealing said cold rolled strip under time and temperature conditions which release said stored energy to reduce, by dissolution and recrystalization, the amount of delta ferrite in said strip to substantially less than said detrimental amount of delta ferrite and to reduce by homogenization the amount of dendritic structure in said strip to substantially less than said detrimental amount of dendritic structure.

2. In a method as recited in claim 1 wherein:

said amount of delta ferrite in said strip at the commencement of cold rolling is greater than about 25% by volume; and said cold rolling and annealing steps reduce, by dissolution and recrystallization, said amount of delta ferrite to below about 20% by volume.

3. In a method as recited in claim 2 wherein:

said cold rolling and annealing steps reduce, by dissolution and recrystallization, said amount of delta ferrite to below about 15% by volume.

4. In a method as recited in claim 1 wherein:

said cold rolling step produces a deformation of at least about 40%.

5. In a method as recited in claim 4 wherein:

said cold rolling step produces a deformation of at least about 50%.

6. In a method as recited in claim 1 wherein:

said annealing step is performed at a temperature of at least about 1100° C. for at least about 5 minutes.

7. In a method as recited in claim 1 wherein said stainless steel strip comprises the following ingredients in wt. %, before cold rolling:

carbon: 0.4 max.;

nickel: 5–38;

chromium: 15–28.

8. In a method as recited in claim 1 wherein said strip is in an as-cast condition at the commencement of said cold rolling step.

9. In a method for producing strip cast, austenitic stainless steel strip, the steps of:

providing a strip cast, austenitic stainless steel strip;

cold rolling said strip;

said strip having a detrimental amount of delta ferrite and a detrimental amount of dendritic structure at the time said cold rolling step is initiated;

said cold rolling step being performed prior to any annealing of said strip, to mechanically fragment dendrites and delta ferrite and produce deformation-generated stored energy sufficient, upon subsequent annealing, (a) to reduce, by dissolution and recrystallization, the amount of delta ferrite in said strip to substantially less than said detrimental amount of delta ferrite and (b) to reduce by homogenization the amount of dendritic structure in said strip to substantially less than said detrimental amount of dendritic structure;

annealing said cold rolled strip under time and temperature conditions which release said stored energy to reduce, by dissolution and recrystallization, the amount of delta ferrite in said strip to substantially less than said detrimental amount of delta ferrite and to reduce by homogenization the amount of dendritic structure in said strip to substantially less than said detrimental amount of dendritic structure;

subjecting said strip to a second cold rolling step following said annealing step; and subjecting said strip to a second annealing step following said second cold rolling step;

said second cold rolling step and second annealing step further reducing the amount of said delta ferrite and essentially eliminating said dendritic structure from said strip.

10. In a method as recited in claim 9 and comprising:

subjecting said strip, following said second annealing step, to a skin pass to improve the surface finish of said strip.

11. In a method as recited in claim 10 wherein:

said skin pass step produces a deformation of about 1–2%.

12. In a method as recited in claim 11 wherein:

said skin pass step produces a deformation of about 1.5%.

13. In a method as recited in claim 10 wherein said strip, following said processing steps, has a gloss index of at least 120.

14. In a method as recited in claim 10 wherein said strip, following said processing steps, has a roughness average ($R_a$) of less than about 20 $\mu$inches (0.51 microns).

15. In a method as recited in claim 10 wherein said strip, following said processing steps, has a waviness average ($W_a$) of less than about 12 $\mu$inches (0.30 microns).

16. In a method as recited in claim 9 wherein:

said strip, after said first-recited annealing step and prior to said second cold rolling step, has at least about 15% delta ferrite by volume; and said second cold rolling and second annealing steps reduce, by dissolution and recrystallization, said amount of delta ferrite to below about 10% by volume.

17. In a method as recited in claim 16 wherein:

said second cold rolling and second annealing steps reduce, by dissolution and recrystallization, said amount of delta ferrite to about 3–5% by volume.

18. In a method as recited in claim 9 wherein:

said strip at the commencement of said first-recited cold rolling step has at least about 30% delta ferrite by volume;

said strip, after said first-recited annealing step and prior to said second cold rolling step, has about 11–20% delta ferrite by volume; and said strip, after said second annealing step, has less than about 10% delta ferrite by volume.

19. In a method as recited in claim 9 wherein:

said first-recited cold rolling step and said second cold rolling step each produces a deformation of at least about 30%.

20. In a method as recited in claim 19 wherein:

said first-recited cold rolling step produces a deformation of at least about 40%; and said second cold rolling step produces a deformation of about 30–40%.

21. In a method as recited in claim 9 wherein:

said first-recited annealing step is performed at a temperature in the range 900°–1300° C.

22. In a method as recited in claim 21 wherein:

said first-recited annealing step is performed at a temperature in the range 1100°–1200° C.

23. In a method as recited in claim 21 wherein:

said second annealing step is performed at a temperature in the range 900°–1300° C.

24. In a method as recited in claim 23 wherein:

said first-recited annealing step is performed for at least about 3 minutes; and said second annealing step is performed for at least about 3 minutes.

25. In a method as recited in claim 9 wherein:

said first-recited annealing step is performed at a temperature of at least about 1200° C. for at least about 3 minutes; and said second annealing step is performed at a temperature of at least about 1200° C. for at least about 3 minutes.

26. In a method as recited in claim 9 wherein:

said first-recited annealing step is performed at a temperature in the range of 1050°–1200° C. for at least about 5 minutes; and said second annealing step is performed at a temperature in the range of 1050°–1200° C. for at least about 5 minutes.

27. In a method as recited in claim 9 wherein:

said first-recited annealing step is performed at a temperature in the range of 1050°–1150° C. for at least about 10 minutes; and said second annealing step is performed at a temperature of at least about 1150° C. for at least about 5 minutes.

28. In a method as recited in claim 9 wherein:

said first-recited annealing step is performed at a temperature of at least about 1200° C.; and said second annealing step is performed at a temperature in the range of 1050°–1150° C.

29. In a method as recited in claim 28 wherein:

said first-recited annealing step is performed for about 3–5 minutes; and said second annealing step is performed for at least about 3 minutes.

30. In a method as recited in claim 9 wherein:

said first-recited cold rolling step produces a deformation of at least about 40%;

said first-recited annealing step is performed at a temperature in the range of 1100°–1200° C. for at least about 5 minutes;

said second cold rolling step produces a deformation of about 30–40%; and said second annealing step is performed at a temperature in the range of 1100°–1200° C. for at least about 3 minutes.

31. In a method as recited in claim 30 and comprising:

subjecting said strip, following said second annealing step, to a skin pass to improve the surface finish of said strip.

32. In a method as recited in claim 9 wherein said stainless steel strip comprises the following ingredients in wt. %, before cold rolling:

carbon: 0.4 max.;

nickel: 5–38;

chromium: 15–28.

33. In a method as recited in claim 9 wherein:

the average size of austenite grains in said strip, after said second annealing step, is about 15–19 microns.

34. In a method as recited in claim 9 wherein said strip is in an as-cast condition during the commencement of said first-recited cold rolling step.

35. An austenitic stainless steel strip having the following properties:

a composition in which the ratio of wt. % Cr to wt. % Ni is from about 18/8 to about 20/9;

a microstructure comprising austenite and less than about 10% delta ferrite by volume;

said microstructure having essentially no residual subsurface dendrites;

said austenite having an average grain size of less than about 19 microns.

36. The austenitic stainless steel strip of claim 35 wherein:

said microstructure comprises about 3–5% delta ferrite by volume.

37. The austenitic stainless steel strip of claim 35 wherein:

said strip has a gloss index of at least 120.

38. The austenitic stainless steel strip of claim 35 wherein:

said strip has a roughness average ($R_a$) of less than about 20 $\mu$inches (0.51 microns).

39. The austenitic stainless steel strip of claim 35 wherein:

said strip has a waviness average ($W_a$) of less than about 12 $\mu$inches (0.30 microns).

40. The austenitic stainless steel strip of claim 35 wherein:

said strip has a thickness of about 1.5–6 mm.

41. The austenitic stainless steel strip of claim 40 wherein:

said strip has a thickness of about 2.5–3.5 mm.

42. The austenitic stainless steel strip of claim 35 wherein:

said austenite has an average grain size of less than about 16 microns.

* * * * *

UNITED STATES PATENT AND TRADEMARK OFFICE

CERTIFICATE OF CORRECTION

PATENT NO. : 5,858,135

DATED : January 12, 1999

INVENTOR(S) : Zofia E. Niemczura and Kenneth E. Blazek

It is certified that error appears in the above-identified patent and that said Letters Patent is hereby corrected as shown below:

At Column 2, line 53, delete "austenitic" and insert --austenite--therefor.

At Column 2, line 56, delete "austenitic" and insert --austenite--therefor.

At Column 2, line 62, delete "austenitic" and insert --austenite--therefor.

At Column 2, line 63, delete "austenitic" and insert --austenite--therefor.

At Column 3, line 28, delete "crackling" and insert --cracking--therefor.

At Column 5, line 66, delete "ascast" and insert --as-cast--therefor.

On the title page, Item [57],

In the Abstract:

Last line, first word, delete "austenitic" and insert --austenite--therefor.

Signed and Sealed this

Twentieth Day of July, 1999

*Attest:*

Q. TODD DICKINSON

*Attesting Officer*

*Acting Commissioner of Patents and Trademarks*